US006026534A

United States Patent [19]

Gonda et al.

[11] Patent Number: 6,026,534

[45] Date of Patent: Feb. 22, 2000

[54] BATHING BALL

[75] Inventors: Frank Gonda, Fairfield, Conn.; Edward John Giblin, Finksburg, Md.; Paul James Mulhauser, New York; Christopher John Brooks, Glen Head, both of N.Y.

[73] Assignee: Lever Brothers Company, New York, N.Y.

[21] Appl. No.: 08/934,991

[22] Filed: Sep. 22, 1997

[51] Int. Cl.[7] ..... A46B 3/22

[52] U.S. Cl. ..... 15/207.2; 15/160; 15/188; 15/209.1; 15/226; 206/77.1

[58] Field of Search ..... 206/77.1; 473/614; 401/196, 268; 15/104.93, 104.94, 160, 188, 210.1, 209.1, 226, 207.2

[56] References Cited

U.S. PATENT DOCUMENTS

| | | | |
|---|---|---|---|
| D. 317,489 | 6/1991 | Stillinger | D21/707 |
| 574,449 | 1/1897 | Pritschau | 51/299 |
| 1,991,559 | 2/1935 | Kingman | 510/439 |
| 2,026,638 | 1/1936 | Kingman | 451/461 |
| 2,581,779 | 1/1952 | Abraham | 15/229.11 |
| 2,654,191 | 10/1953 | Pusch | 15/118 |
| 2,817,865 | 12/1957 | Arioli | 401/201 |
| 3,103,031 | 9/1963 | Winston | 15/104.93 |
| 3,146,479 | 9/1964 | Stoker | 15/118 |
| 3,165,776 | 1/1965 | Tuseth | 15/167.1 |
| 3,226,751 | 1/1966 | Lemelson | 15/118 |
| 3,254,357 | 6/1966 | Caul et al. | 15/118 |
| 3,295,156 | 1/1967 | Brant | 15/207.2 |
| 3,414,928 | 12/1968 | Lemelson | 15/118 |
| 3,634,901 | 1/1972 | Landsberg | 15/118 |
| 3,759,518 | 9/1973 | Mroz | 473/614 |
| 3,761,418 | 9/1973 | Parran | 510/382 |
| 3,853,412 | 12/1974 | Griffin | 15/167.1 |
| 4,027,352 | 6/1977 | Wagner | 15/229.12 |
| 4,154,542 | 5/1979 | Rasmason | 401/7 |
| 4,190,550 | 2/1980 | Campbell | 15/104.93 |
| 4,199,835 | 4/1980 | Heyer et al. | 15/229.11 |
| 4,214,341 | 7/1980 | Rath | 15/210.1 |
| 4,343,061 | 8/1982 | Hanazono | 15/244.3 |
| 4,406,032 | 9/1983 | Diamant | 15/207.2 |
| 4,462,135 | 7/1984 | Sanford | 15/105 |
| 4,606,964 | 8/1986 | Wideman | 428/152 |
| 4,756,529 | 7/1988 | Stillinger | 473/614 |
| 4,802,255 | 2/1989 | Breuer et al. | 15/167.1 |
| 4,927,141 | 5/1990 | Paranto | 473/413 |
| 4,962,926 | 10/1990 | Chen | 473/614 |
| 4,969,225 | 11/1990 | Schubert | 15/229.12 |
| 4,980,943 | 1/1991 | Barber | 15/227 |
| 5,144,744 | 9/1992 | Campagnoli | 29/446 |
| 5,312,934 | 5/1994 | Letton | 554/98 |
| 5,389,279 | 2/1995 | Au et al. | 424/70.19 |
| 5,465,452 | 11/1995 | Girardot et al. | 15/210.1 |
| 5,517,705 | 5/1996 | Jackson | 15/160 |
| 5,533,227 | 7/1996 | Ito et al. | 5/207.2 |
| 5,650,384 | 7/1997 | Gordon et al. | 510/159 |
| 5,678,275 | 10/1997 | Derfner | 15/207.2 |
| 5,727,278 | 3/1998 | Per-Lee | 15/229.11 |
| 5,813,523 | 9/1998 | Gnadt et al. | 206/77.1 |

FOREIGN PATENT DOCUMENTS

| | | | |
|---|---|---|---|
| 0561498 | 10/1923 | France | 15/207.2 |

*Primary Examiner*—Mark Spisich
*Assistant Examiner*—Theresa T. Snider
*Attorney, Agent, or Firm*—Gerard J. McGowan, Jr.

[57] ABSTRACT

A washing system using a washing implement including floppy filaments free at one end, which may be in the shape of a ball, together with a surfactant-based cleanser.

16 Claims, 3 Drawing Sheets

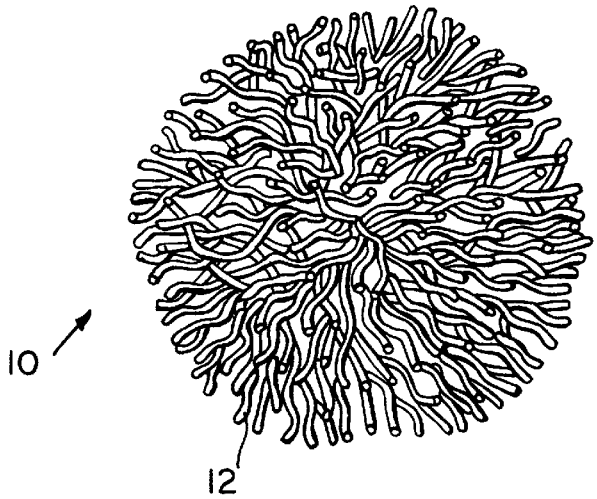
FIG. 1
FIG. 2
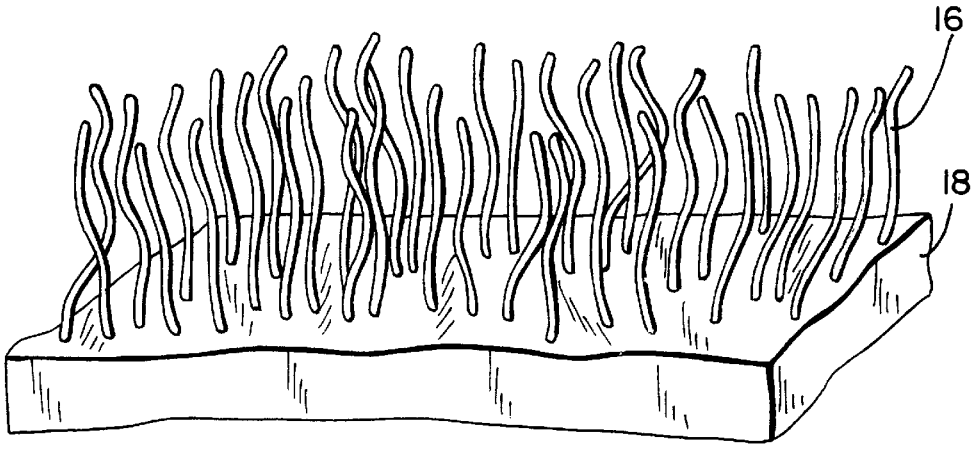

FIG.5
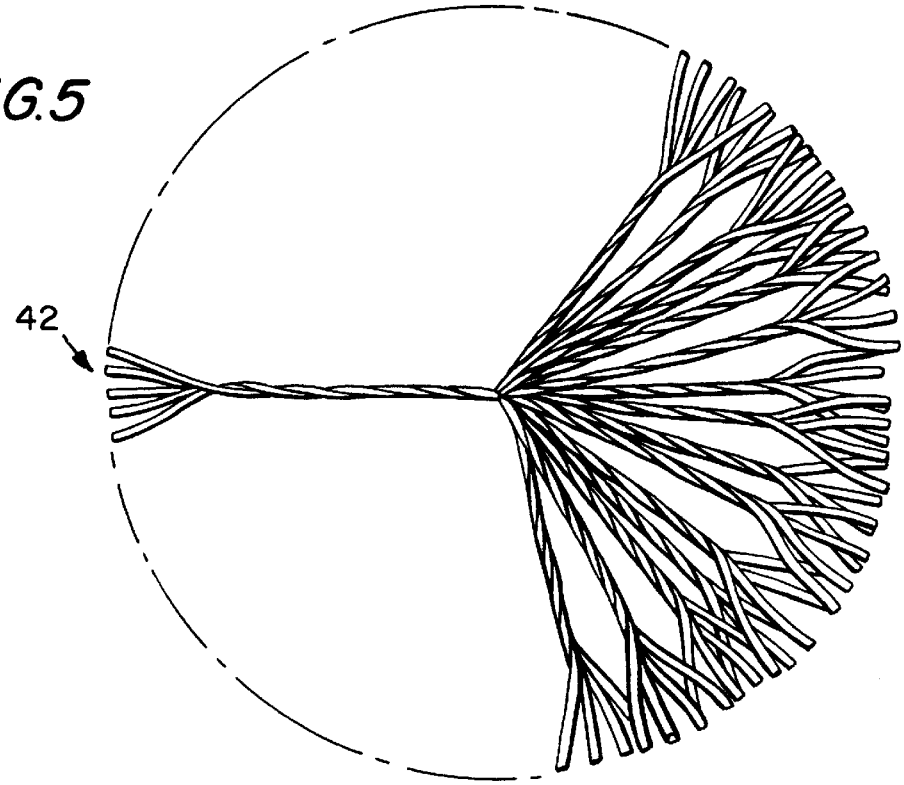
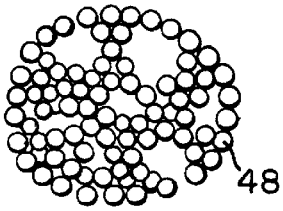
FIG.6
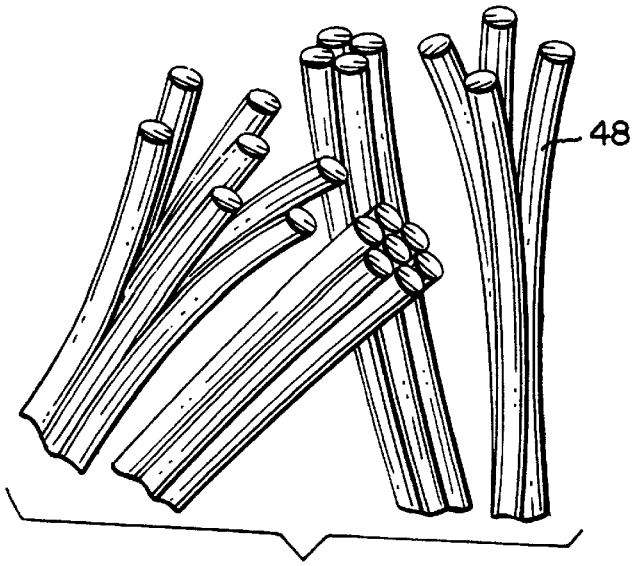
FIG.7

BATHING BALL

BACKGROUND OF THE INVENTION

Liquid personal washing cleansers have recently been gaining in popularity. A difficulty with their use is that there is lacking a solid, tangible washing implement, such as a soap bar, which the consumer is accustomed to use, e.g. in the shower. Also, it would be beneficial to improve the lathering of the liquid cleansers.

Campagnoli, U.S. Pat. No. 5,144,744 discloses a diamond-mesh polyethylene sponge obtained by stretching a plurality of tubes, binding all of the tubes together near a common center of all of the stretched tubes and releasing all the tubes from their stretched condition whereby the tubes through their resiliency rebound into a rounded sponge shape. As illustrated in the Campagnoli patent, the diamond mesh sponge has a "frilly" appearance which does not appeal equally to male and female users.

Sanford, U.S. Pat. No. 4,462,135 discloses a cleaning and abrasive scrubber which is made in part of numerous layers of netting mesh polymeric material. An abrasive solid is used which is a coiled product such as may be obtained from shavings of metals such as steel, brass and copper. The solid must be hard enough to give the necessary abrasive action, but flexible enough to be coiled around the center core. The solids may be prepared from a variety of materials which meet this requirement such as metal, wood, plastic and the like. The Sanford scrubbers are said to be useful for a great many applications, including cleaning and scrubbing the various parts of the body.

WO 95/00116 discloses a system for cleaning the skin which comprises a diamond mesh sponge and a liquid cleansing and moisturizing composition, which system is said to have excellent lather.

Lemelson, U.S. Pat. No. 3,226,751 discloses a combination sponge and scouring device. The implement includes a soft and flexible cellular base section made of any suitable, flexible expanded plastic and scouring elements.

Lemelson, U.S. Pat. No. 3,414,928 discloses a combination sponge and scour. The device includes a cellular expanded plastic base, an unexpanded material secured to a portion of the surface of the base, and a plurality of scouring elements secured to and supported by the unexpanded plastic material. In one method of manufacture, plastic scouring material may be disposed against the cellular member, while molten, and compressed, whereby at least a portion of the cellular member is embedded in the molten surface layer to become encapsulated when it solidifies.

Wagner, U.S. Pat. No. 4,027,352 discloses a scouring pad made with a strip of expanded plastic material having one end folded over a stiff plastic contoured member to provide a controlled contour to the pad.

Landsberg, U.S. Pat. No. 3,634,901 discloses a combined cleaning and abrading or scouring utensil. It comprises an absorbent pad having a plurality of crinkled or wavy monofilament plastic elements of angular sharp edged cross section. The scouring elements are functionally secured to the pad as by one or more curved needles.

Barber, U.S. Pat. No. 4,980,943 discloses a cleaning glove including a glove base having a side to which there is attached a primary layer of a tufted blended yarn and one or more fibrous bristle portions or strips.

Girardot et al., U.S. Pat. No. 5,465,452 discloses a first extended tubular scrim having a diamond mesh pattern used to construct a personal cleaning implement. The first scrim is placed in an oven to heat set the scrim in a pleated and expanded condition. A second piece of tubular scrim is placed inside the pleated and expanded first tubular scrim and the first end of the second piece is inverted over the outside of the pleats and connected to the other end to envelope the pleated and expanded scrim tubing. The implement has a high open area without a dense center core which would inhibit rinsing and drying. If desired, the second piece of scrim may be made of a different scrim material then the first scrim in order to provide the implement with a softer feeling, skin contacting implement surface.

Rasmason, U.S. Pat. No. 4,154,542 is directed to a shower mitt which includes a mesh sheet of nylon net to provide a soap-retaining pocket.

Wideman, U.S. Pat. No. 4,606,964 is directed to a bulked web composite which comprises a differentially tensioned reticulated web of elastic material banded to at least one gatherable web.

Abraham, U.S. Pat. No. 2,581,779 discloses a scouring pad said to have a greater ease of manipulation.

Winston, U.S. Pat. No. 3,103,031 discloses a composite scouring pad made by folding plastic fibers with metallic filaments into an open batt.

Caul et al., U.S. Pat. No. 3,254,357 is directed to a cleaning pad which is a felt of randomly arranged animal hair, the pad having a stiff scrubbing side in which the individual hair fibers are coated with a thermoset resin and a flexible side free from said resin. An object is to have a scrubbing side and a polishing side.

Stillinger, U.S. Pat. No. 4,756,529 is directed to a substantially spherical amusement device formed from a large plurality of floppy elastomeric filaments that radiate in a dense, bushy manner from a central core region. The filaments are said to be sufficiently floppy to collapse on impact. The features of the device are said to promote sure and quick capture of the device during the act of catching.

Oddz On Products, Inc. of Campbell, Calif. sells a product called "Krinks" which is similar to the device of the Stillinger '529 patent, except that the filaments are curled.

Stillinger, U.S. Pat. No. DES 317,489 is directed to the ornamental design for a throwing toy. The throwing toy appears to be substantially spherical and to be composed of filaments radiating from a central core. It appears to be somewhat similar to that disclosed in Stillinger, U.S. Pat. No. 4,756,529, mentioned above.

Paranto, U.S. Pat. No. 4,927,141 is directed to a novelty ball having a multiplicity of extending flexible whisker like protrusions.

Arioli, U.S. Pat. No. 2,817,865 discloses a sponge covered strand washcloth with soap pocket. The strands cross and are interwoven.

Kingman, U.S. Pat. No. 1,991,559 is directed to a detergent abrasive scouring pad. The pad comprises an outer enveloping integument of more or less open mesh metallic abrasive fabric and an inner integument of material normally offering strong resistance to penetration therethrough of liquid and a central mass of soapy detergent material enclosed by the inner integument. The mesh metallic fabric is preferably a tubular knitted fabric produced from a flat or ribbon like metallic strand or wire.

Campbell, U.S. Pat. No. 4,190,550 is directed to a fibrous soap filled pad which when used as a bathing aid imparts a cleansing and mildly stimulating rubbing action to human skin. A seamless envelope of crimped resilient stretchy synthetic fibers surrounds a core of solid soap or other suitable surfactant material and is held in integral form solely by the interentanglement of the fibers. The fibrous soap filled pad is useful in imparting a cleansing and mildly stimulating rubbing action to human skin during bathing. In an alternative form, a ball of loose fibers can be formed into an integral spherical shape by needling after which melted soap can be injected or impregnated into its interior to form a solid case.

Kingman, U.S. Pat. No. 2,026,638 is directed to a hand held implement for cleaning, scouring and polishing kitchen utensils, metal and other surfaces which require the application of abrasive action to effect best results. The scouring implement includes a foraminous resilient body such as a mass of sponge rubber having imposed upon the major portion of its external surface a metal mesh. The foraminous body may be saturated with a suitable cleansing fluid such as, e.g. soap and water. The mesh is preferably of a knitted formation although other cross sectional shapes of wire or strand may be employed. As the implement is rubbed back and forth over the surface, the edges of the metallic loops of the mesh will exert a strong scraping effect to loosen and scrape away encrusted and cakes dirt and soil.

Pusch, U.S. Pat. No. 2,654,191 is directed to a pot cleaner comprising a deep pile fabric, preferably composed of terry cloth or Turkish toweling and having uncut pile loops forming the nap thereof. It is said that the terry cloth component base fibers will remain soft, pliable and highly absorptive of water, more especially of soapy water and a detergent solution. The cleaning cloth is designed for heavy duty work in the cleaning of pots, pans and the like.

Stoker, U.S. Pat. No. 3,146,479 is directed to an ornamental device for scouring, washing and drying surfaces, particularly bathroom fixtures such as wash bowls and the like. A long folded strip of nylon net is wound upon itself to form a loose roll which simulates the petals of a flower. A base made of spongy water absorbent material such as sponge rubber supports the flower simulating portion. Nylon net is said to have the property of springiness and is said to be gently abrasive to serve as a brush for cleaning purposes. It is said to resume its original form after having been compressed and deformed in use. The net is said to lack water absorptive properties. The function of absorbing water is achieved by the spongy base. The folded edge of the nylon net is said to function like a brush as it is passed back and forth over the surface being cleaned. Instead of nylon net, other materials having the properties of springiness and non-absortiveeness may be used.

Heyer et al., U.S. Pat. No. 4,199,835 is directed to a scouring pad in the shape of a ball comprising a plurality of radial slit regular shaped planar segments of conformable low density non-woven abrasive product fastened together under compression at the center. The use of lofty, fibrous, non-woven abrasive products for scouring pots and pans which are typically open mats formed from randomly disposed crimped staple fibers which are bonded at points where they intersect and contact each other with a binder is described as known. The segments may be interleaved with layers of foam material to provide for specific properties.

Schubert, U.S. Pat. No. 4,969,225 is directed to improved scrub brushes specifically made to contain a bar of soap for use for bathing, cleansing and the like. The invention utilizes an elastic, synthetic, fibrous batt or chemical foam. The batt or open-cell chemical foam is formed into a desirable shape to include an internal cavity or tunnel to contain a bar of soap or other solid cleansing substance. The batt may be made of a woven synthetic material or surrounded by a netting of woven synthetic material. The brush could be made with grooves or cuts in the face for improved scrubbing action.

Pritschau, U.S. Pat. No. 574,449 is directed to a sponge treated with abrasive powder.

Rath, U.S. Pat. No. 4,214,341 is directed to a sponge for medicinal purposes. The sponge is made of fabric cut, preferably gauze fabric cut which is folded to a pouch with an edge framed by a rubber ring and folded inside out.

Hanazono, U.S. Pat. No. 4,343,061 is directed to a bathroom implement and specifically to a body washing implement which is said to be useful when used in combination with a towel or washcloth for washing an area of the body of a bath user that is difficult of access by his hands or by the towel or washcloth. The implement comprises a sponge member having at least one closed loop portion and a covering web wrapping the sponge member therein. The covering web having the sponge wrapped therein is preferably comprised of a woven, non-woven, knitted or braided fabric which is relatively coarsely meshed. The washing implement of the '061 patent may be used as a bath sponge independently of any other washing implement but is said more advantageously to be used in combination with an elongated strip of cloth such as a washing towel.

SUMMARY OF THE INVENTION

A new washing system has been discovered which includes a washing implement which may have a less "frilly" appearance than many of the sponges or "poufs" presently on the market. Thus, the invention provides the consumer with an object to generate lather, particularly in conjunction with liquid washing products, which may be expected to have a more uniform appeal to men, women and children. The washing implement of the invention comprises a plurality of filaments which are fixed at one end and free at a second end. Preferably the filaments are polymeric and/or floppy.

In general the cross-sectional dimensions of each filament will be small in relation to the length of the filament. The filaments may be elastomeric or non-elastomeric. Preferably use of a large plurality of tiny filaments offer substantial gripping surface area. Indeed, the user of the washing implement will be enabled to thread his or her fingers through the filaments. While the use of filaments that have a very small diameter as compared to filament length is envisioned primarily, the use of larger filaments may also be advantageous.

A preferred washing implement according to the invention is the amusement device described in Stillinger, U.S. Pat. No. 4,756,529, although it may be desirable to replace his rubber, elastomeric filaments with non-rubber and/or non-elastomeric filaments. Likewise, the appearance of the washing implement of the present invention may be as illustrated in Stillinger, U.S. Pat. No. DES 317,489. Both Stillinger, U.S. Pat. No. 4,756,529 and Stillinger, U.S. Pat. No. DES 317,489 are hereby incorporated by reference herein. When the washing implement takes the form illustrated for the amusement device of Stillinger, it is substantially spherical with a plurality of floppy filaments radiating in a dense, bushy manner from a central core region. Generally, in this embodiment, the filaments will radiate outwardly in plural offset planes. In this embodiment, the washing implement is perceived as being "toylike," whereby it will appeal to men, women and children. Indeed, it can be used to promote washing as "fun."

In the implement of the invention, the plurality of filaments is used to form the skin contacting surfaces.

The washing system of the invention comprises the washing implement and a surfactant-based cleanser. The surfactant-based cleanser may be a conventional soap bar, a mild surfactant bar such as those made under the Dove® and Caress® brand names, or, more preferably, the washing implement is used in conjunction with a liquid or semi-liquid surfactant-based cleanser. It is the use with the liquid cleansers wherein the washing implement finds its greatest utility, since there is a need with liquid cleansers for the consumers to have an implement to grasp and with which to generate lather. The liquid cleanser may comprise conventional surfactants such as soaps or synthetic surfactants such as mild surfactants found in products such as Dove® and Caress® mild washing bars.

In a particularly preferred embodiment, the liquid cleanser of the washing system includes a moisturizing and/or conditioning ingredient in addition to a surfactant. The desire for an implement to generate lather in a washing system including a moisturizing cleansing composition is mentioned in WO 95/00116.

The invention is also directed to a method of using a ball comprising floppy filaments as a washing implement in personal washing. The invention is also directed to a ball comprising floppy filaments of non-elastomeric material.

The filaments of the present invention are free at one end and are therefore monofilaments rather than the loops shown in FIG. 7 of the Stillinger '529 patent.

For a more complete understanding of the above and other features and advantages of the invention, reference should be made to the following detailed description of the preferred embodiments and to the accompanying drawings.

BRIEF DESCRIPTION OF THE DRAWINGS

FIG. 1 is a perspective view of the washing implement of the invention.

FIG. 2 is a perspective view of an alternate embodiment of the invention.

FIG. 5 is a partial cross section of one alternate embodiment of the invention.

FIGS. 6 and 7 are perspective views of strands according to the invention.

DETAILED DESCRIPTION OF THE INVENTION

Figure 3:
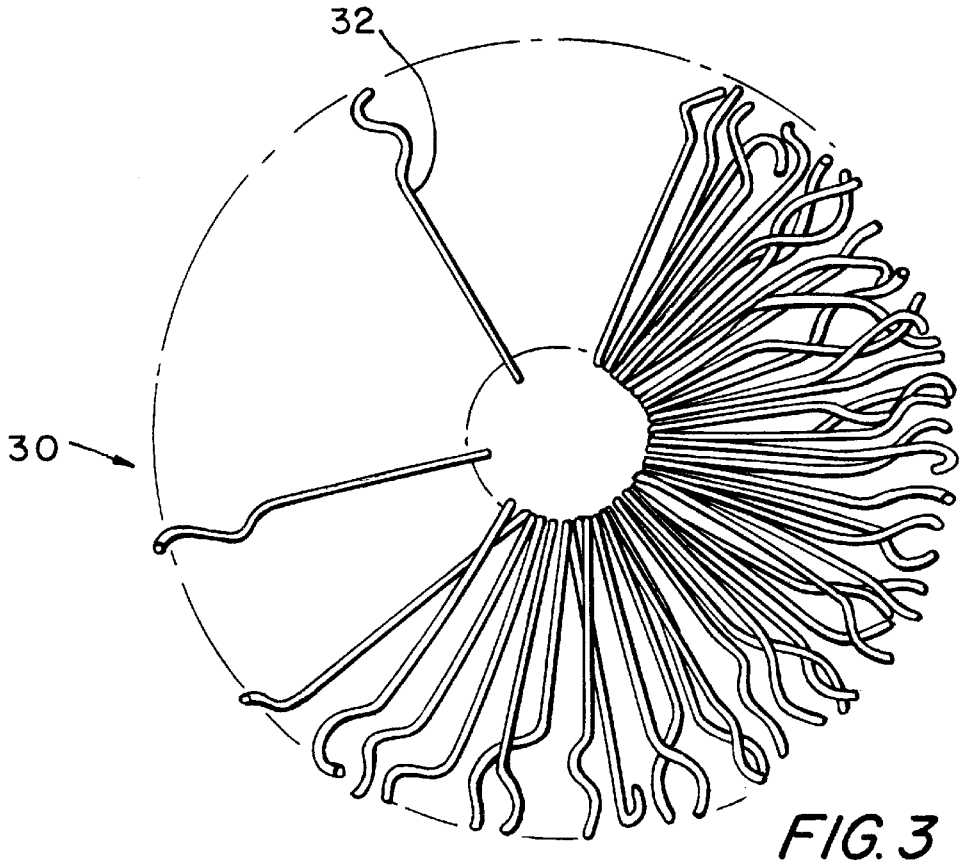
FIG. 3 is a perspective view of an alternate "kinked" embodiment.

The washing implement 10 is formed by joining a plurality of floppy filaments in a central core region so that they radiate outwardly in a fairly uniform dense and bushy fashion in multiple angularly offset planes to form a substantially spherical configuration. Preferably the diameter of implement 10 ranges from about two inches to about six inches, especially from about three to about five inches.

The filaments 12 of which the washing implement 10 are fabricated are made of a relatively soft, preferably floppy material, preferably one which feels quite soft to the skin. In contrast with prior toy balls, the filaments of the implement of the present invention will generally be made of a non-rubber material. As disclosed for the toy of Stillinger, U.S. Pat. No. 4,756,529, the washing implement may be made by stretching loops of the filament material, disposing these loops at angles relative to each other, cinching the loops centrally and drawing them tightly together. The loops are then cut to form filaments which are unattached at one end. The filaments of FIG. 1 are flexible but rod- or ribbon-shaped. Moreover, while in FIG. 1 the preferred form of the washing implement is that of a ball, the floppy filaments may be used in another form. For instance, in FIG. 2, filaments 16 are attached to base 18.

It is preferred when the cleaning implement takes the form of a ball that it does not include a rigid handle, eg of plastic. The implement may include an optional cord for, e.g. hanging in the shower.

The floppy filament is preferably made of a polymer such as polyethylene and advantageously is somewhat resilient. The material may also be made of additional polymers of olefin monomers other than ethylene or of polyamides of polycarboxylic acids and polyamines. An alternative material is nylon. The materials from which the implements are formed are preferably strong, flexible polymeric materials. Another possible material is latex which is highly compressible and has excellent elongation.

Floppy filaments are soft and flexible, tending to move irregularly to and fro or up and down. Due to their loose and flexible character the floppy filaments of the washing implement tend to kiss against the skin of the user.

The filaments may be microtextured as by adding dimples, bumps or another pattern or pattern to the surface of the filaments. It can be expected that the texturing of the filaments will improve lathering, skin cleaning and skin feel.

The cinching device may be a cord made of a natural material such as rope or a synthetic polymer such as nylon, polyethylene or polypropylene.

The filaments herein are individual rod- or ribbon-like structures preferably polymeric, and are free at one end, rather than the loop disclosed in Stoker, U.S. Pat. No. 3,146,479. Also, the filaments are not a netting material.

In general, the diameter for the filaments will range from 0.25 to 3 mm, preferably from 0.75 to 1.5 mm. By "diameter" in this context is meant the maximum width or thickness in the case of a ribbon-like structure or the like, or the true diameter in the case of a rod-like structure. In general, the length of the filaments will be from 0.5 inches to 4 inches, especially from 1 to 2.5 inches for non-crimped filaments and from 1 to 8 inches, especially from 2 to 6 inches for crimped filaments (measured with the filament straightened). Although the preferred shape for the implement is spherical, other shapes such as a flattened oval, a football or a FIG. 8 are contemplated. The filaments are preferably straight since this makes for a less "frilly" appearance, but they can also be curled or crimped. As indicated above, to improve lathering or cleaning of the skin, if desired, the filaments may be micro texturized, e.g. to provide a non-smooth surface along their diameters, thickness or depths.

Figure 4:
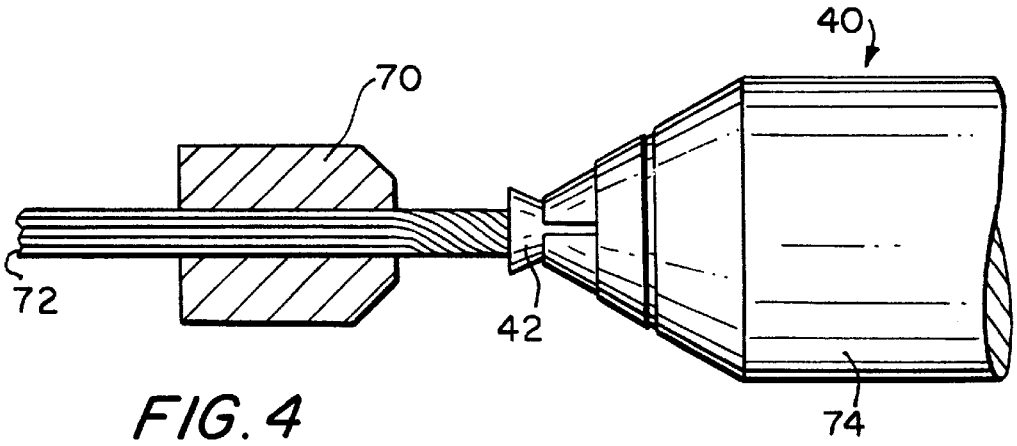
FIG. 4 is a schematic diagram of a process for making the kinked filaments of FIG. 3.

A bathing ball 30 with kinked filament 32 is illustrated in FIG. 3. A process for making the 30 filaments is illustrated in FIG. 4 wherein a drill 40 is used to coat nylon filaments with latex using a latex tube 42. The filaments 72 traverse mask 70 and are held under tension. Heat is applied to the filaments between tube 42 and mask 70. The drill chuck 74 is pulled in the direction away from the mask while the filaments are slowly wound. The nylon filament material stresses, fatigues and breaks to form the kinked tips seen in the bound filaments 32 of FIG. 3.

In FIG. 5, the bathing ball 40 is provided with fused filament strands having frayed ends 42. The strands are dispensed from a bound core. The filaments may be made of ink marker nylon tip wick stock 48 seen in FIGS. 6 and 7.

The implement of the invention is used in conjunction with a liquid cleaning formulation which includes a surfactant while the cleaning formulation is preferably liquid or semi liquid, e.g. not a soap bar, soap bars may be used. The system of the invention may, for instance, be sold in the form of a pack or kit. In its preferred form, the system includes a cleaning formulation which is suitable for application to the human skin. Even more preferably, the cleaning formulation includes a skin conditioning and/or moisturizing ingredient.

Preferably the surfactant is a mild surfactant. It is also preferred that the surfactant is a foaming surfactant. The surfactant should be a relatively mild surfactant suitable for washing human skin and may be, e.g., an anionic, amphoteric, cationic or nonionic surfactant. Among the mild surfactants which may be used are cocamidopropyl betaine, sodium cocoylisethionate and mild soap. Among other surfactants which may be used are soap and sodium laureth sulfate.

Moisturizers and conditioners may include oils, cationic and certain nonionic and anionic surfactants. Among the moisturizers which may be used are polyols such as glycerin and glycerine, propylene glycol, polyethylene glycol, mono, di and tri-esters, lanolin, and its derivatives, mineral oil, petrolatum, vegetable oils, silicone gum, silicone oil and quaternary compounds. A preferred moisturizer is the dimethicone emulsion sold as Dow Q2-1656, which is a 50% silicone emulsion. Other moisturizers include adducts of vegetable oil with acrylic acid, fumaric acid or maleic anhydride, epidermal and sebacious hydrocarbons such as cholesterol, and squalene and derivatives such as esters, and skin moisturizing cationic polymers such as cationic polysaccharides. Other ingredients such as thickeners such as ammonium sulfate and opacifiers such as mica/titanium dioxide may be used. Water, of course, may also be included.

The cleanser may be single phased, eg. it may contain only an aqueous phase, or it may include more than one phase, eg. an oil phase (eg. moisturizers) and an aqueous phase. It may be an emulsion or a microemulsion.

Preferably surfactants are employed such that the surfactant, if used alone, or the surfactant mixture is milder than would be soap itself as measured by the zein solubilization test (soap yields 80% zein solubilized). Preferably the zein solubilization is in the range of 10–60%.

Among suitable anionic co-actives are the alkyl ether sulfates, acyl isethionates, alkyl ether sulfonates, sarcosinates, sulfosuccinates, taurates and combinations thereof. Among suitable amphoteric co-actives may be included alkylbetaines, amidopropyl betaines, amidopropyl sultaines and combinations thereof.

Alkyl ether sulfates used in the present invention may be of the general formula $R\text{-}(OCH_2CH_2)_nOSO_3\text{-}M^+$ wherein R ranges from $C_8$–$C_{20}$ alkyl, preferably $C_{12}$–$C_{15}$ alkyl, n is an integer from 1 to 40, preferably from 2 to 9, optimally about 3, and $M^+$ is a sodium, potassium, ammonium or triethanolammonium cation.

Typical co-actives of this variety are listed below:

Sodium Laureth Sulfate (liquid or paste)
TEA Laureth Sulfate (paste)
Sodium Laureth-12 Sulfate (liquid)
Sodium Trideceth Sulfate (paste)
Ammonium Laureth Sulfate (liquid)

Alkyl ether sulfonates may also be employed in the present invention. Illustrative of this category is a commercial product known as Avenel S-150 commonly referred to as a sodium $C_{12}$–$C_{15}$ Pareth-15 sulfonate.

Another co-active type suitable for use in the present invention is that of the sulfosuccinates. This category is best represented by the monoalkyl sulfosuccinates having the formula $RO_2CCH_2CH(SO_3—Na^+)COO—M^+$; and amido-MEA sulfosuccinates of the formula: $RCONHCH_2CH_2O_2CCH_2CH(SO_3—M^+)COO—M^+$; wherein R ranges from $C_8$–$C_{20}$ alkyl, preferably $C_{12}$–$C_{15}$ alkyl and $M^+$ is a sodium, potassium, ammonium or triethanolammonium cation. Typical commercial products representative of these co-actives are those listed below:

Disodium Lauryl Sulfosuccinate (solid)
Disodium Cocoamido MEA Sulfosuccinate (liquid)
Disodium Myristamido MEA Sulfosuccinate (paste)
Disodium Oleamido MEA (liquid)
Disodium Ricionoleamido MEA Sulfosuccinate (solid)

Sarcosinates may also be useful in the present invention as a co-active. This category is indicated by the general formula $RCON(CH_3)CH_2CO_2—M^+$, wherein R ranges from $C_8$–$C_{20}$ alkyl, preferably $C_{12}$–$C_{15}$ alkyl and $M^+$ is a sodium, potassium ammonium or triethanolammonium cation. Typical commercial products representative of these co-actives are those listed in the Table below:

Sodium Lauroyl Sarcosinate (Solid)
TEA Cocoyl/Sarcosinate (Liquid)

Taurates may also be employed in the present invention as co-actives. These materials are generally identified by the formula $RCONR'CH_2CH_2SO_3—M^+$, wherein R ranges from $C_8$–$C_{20}$ alkyl, preferably $C_{12}$–$C_{15}$ alkyl, R' ranges from $C_1$–$C_4$ alkyl, and $M^+$ is a sodium, potassium, ammonium or triethanolammonium cation. A typical co-active is listed below:

Sodium Methyl Cocoyl Taurate (paste)

Within the category of amphoterics there are three general categories most suitable for the present invention. These include alkylbetaines of the formula $RN^+(CH_3)_2CH_2CO_2—M^+$, amidopropyl betaines of the formula $RCONHCH_2CH_2CH_2N^+(CH_3)_2CH_2CO_2—M^+$, and amidopropyl sultaines of the formula $RCONHCH_2CH_2N^+(CH_3)_2CH_2SO_3—M^+$ wherein R ranges from $C_8$–$C_{20}$ alkyl, prefera $C_{12}$–$C_{15}$ alkyl, and $M^+$ is a sodium, potassium, ammonium or triethanolammonium cation, Typical of these co-actives are:

Cocamidopropyl Betaine (liquid)
Cocamidopropyl Hydroxysultaine (Liquid)
Coco-Betaine (Liquid)
Myristamidopropyl Betaine (Liquid)
Oleyl Betaine (Paste)

Within the broad category of liquid actives, the most effective are the alkyl sulfates, alkyl ether sulfates, alkyl ether sulfonates, sulfosuccinates, and amidopropyl betaines.

Another preferred surfactant is an acyl isethionate having the formula:

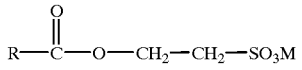

in which R denotes a linear or branched alkyl group and M denotes an alkali metal or alkaline earth metal or an amine.

Another surfactant which may be used are the monoalkyl or dialkylphosphate surfactants.

Another mild surfactant which may be used, preferably used as primary surfactant in combination with other surfactants noted above, is sodium coco glyceryl ether sulfonate. While desirable to use because of its mildness properties, this coco AGS alone does not provide optimum lather creaminess. A sodium 90/10 coconut/tallow alkyl AGS distribution is preferred for creaminess. Salts other than the sodium salt such as TEA-, ammonium, and K-AGS and chain length distributions other than 90/10 coconut/tallow are usable at moderate levels. Also, some soap may be added to improve lather volume and speed of lathering. Certain secondary co-surfactants used in combination with AGS can also provide a creamier and more stable lather. These secondary surfactants should also be intrinsically mild. One secondary surfactant that has been found to be especially desirable is sodium lauroyl sarcosinate (trade name Hamposyl L, made by Hampshire Chemical).

The amphoteric betaines and sultaines noted above can be used as the sole surfactant, but are more preferred as a co-surfactant. Nonionics generally should not be used as the sole surfactant in this product if high foaming is desirable; however, they can be incorporated as a co-surfactant.

Nonionic and cationic surfactants which may be used include any one of those described in U.S. Pat. No. 3,761,418 to Parran, Jr., hereby incorporated by reference into the present application. Also included are the aldobionamides as taught in U.S. Pat. No. 5,389,279 to Au et al; and the polyhydroxy fatty acid amides as taught in U.S. Pat. No. 5,312,934 to Letton, both of which are incorporated by reference into the present application.

Soaps can also be used. Preferably, soaps are used at levels of from about 1 to 10 wt % and at higher levels preferably where the surfactant mixture is milder than soap. The soaps may be added neat or made in situ via adding a base, e. g., NaOH; to convert free fatty acids. Preferably, soaps are only be used as cosurfactants to the extent that the surfactant system is milder than soap alone.

A preferred surfactant active system is one such that acyl isethionate comprises 1 to 15% by weight of the total composition, an anionic other than acyl isethionate (e.g., ammonium lauryl ether sulfate) comprises 1 to 15% by weight of the total composition and amphoteric comprises 0.5 to 15% by weight of the total composition.

Another preferred active system is one comprising 1 to 20% alkyl ether sulfate. Preferred surfactant active systems may also contain 1 to 10% alkali metal lauryl sulfate or $C_{14}$–$C_{16}$ olefin sulfonate instead of acyl isethionate.

Preferably the surfactant or surfactant system is used in a liquid cleansing formulation having, for example, from about 10% to about 99% water.

The compositions of the invention preferably comprise anionic surfactants which are not nitrogen-containing anionic surfactants.

The surfactant is preferably present at a level of from 2 to 50 wt. %, especially from 5 to 25 wt. % of the cleansing composition. The moisturizing agent is preferably present at from 0.5 to 35 wt. %, especially from 2 to 20 wt. %, particularly from 2 to 8 wt. %.

Further additional ingredients which may be employed include preservatives, pH adjusting agents such as citric acid and sodium hydroxide, perfumes, dyes, suspending agents such as magnesium/aluminum silicate, and sequestering agents such as EDTA.

The cleansers used in the present invention may be shower gels such as those sold under the following brand names by Lever Brothers Company, New York, N.Y.: Dove Moisturizing Body Wash, Caress Moisturizing Body Wash, and Lever 2000 Moisturizing Body Wash.

Although the polymeric material of which the filamentous sponge or implement of the invention is made may be inherently mildly abrasive to the skin, it preferably does not incorporate abrasive particles or a scouring material. Thus, abrasives such as pumice, aluminum oxide, volcanic ash, and silica are preferably omitted. Surfactants which are so harsh that they are not typically used for products designed to wash the skin are best avoided in compositions according to the present invention. Likewise, the filamentous sponge should not be ammonia- or oxygen-releasing and preferably does not include bleaching materials. By "personal washing" herein is meant washing of the skin of human beings.

Example 1 (Prophetic)

The implement of FIG. 1 made of polyethylene is packaged together with a separate cleansing agent including cleaning and moisturizing ingredients set forth below to form a system. None of the cleansing agent is impregnated or otherwise initially incorporated onto or into the implement. In one trial, the system is used by placing the washing and moisturizing agent onto the skin of the person washing and then scrubbing with the implement. In a second trial, the cleansing agent is placed on the sponge and then scrubbing is carried out.

| Full Chemical Name or CTFA Name | % Active Level in Formulation | Tradename and Active |
|---|---|---|
| Water | to 100.00 | Deionized Water |
| Cocamidopropyl Betaine | 8.0 | Tegobetaine F @ 30% (ex. Goldschmidt) |
| Sodium Cocoyl Isethionate | 5.0 | Jordapon CI-ADH @ 86% |
| Dimethicone/Laureth-4/Laureth-23 | 5.0 | Dow Q2-1656 (50%) Silicone Emulsion |
| Sodium Laureth Sulfate | 2.0 | Standapol ES-3 @ 28% |
| Ammonium Sulfate | 1.25 | Ammonium Sulfate @ 100% |
| Fragrance | 0.6 | |
| Mica/Titanium Dioxide | 0.2 | Timiron MP-30 @ 100% |
| DMDM Hydantoin | 0.2 | Glydant XL 1000 @ 100% |
| BHT | 0.0075 | BHT @ 100% |
| Guar Hydroxypropyl-trimonium Chloride | 0.1 | Jaguar 13S @ 100% |

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A personal washing system comprising a liquid or semi liquid surfactant-based cleanser suitable for personal washing and a washing implement including filaments attached at one end and free at the other wherein the washing implement forms substantially a sphere having a center and a periphery and said filaments are floppy and are fastened to each other at the center of the sphere and free at the periphery of the sphere.

2. The washing system according to claim 1 wherein the filaments are rod-shaped.

3. The washing system according to claim 1 wherein the filaments are polymeric.

4. The washing system according to claim 1 wherein the filaments are non-rubber.

5. The washing system according to claim 1 wherein the filaments are non-elastomeric.

6. The washing system according to claim 1 further comprising a base, said filaments being attached to said base.

7. The washing system according to claim 1 further comprising a skin conditioning or moisturizing ingredient in said cleanser.

8. The washing system according to claim 1 wherein said surfactant is a salt of a fatty acid.

9. The washing system according to claim 1 wherein said surfactant is directly esterified isethionate.

10. The washing system according to claim 1 wherein said cleanser is a liquid cleanser.

11. The washing system according to claim 1 wherein filaments on opposite sides of said periphery are made from a single loop.

12. The personal washing system according to claim 1 wherein said filaments are microtextured.

13. The personal washing system according to claim 1 wherein the filaments are frayed at their free ends.

14. A washing system comprising a liquid or semi liquid surfactant-based cleanser and a washing implement including filaments attached at one end and free at the other, said washing implement forming substantially a sphere, said attached ends of said filaments being attached at a center of said sphere, said filaments being free of attachment at a periphery of said sphere.

15. The washing system according to claim 14 wherein said filaments are rod-shaped.

16. The washing system according to claim 15 wherein said cleanser is a liquid cleanser.

* * * * *

UNITED STATES PATENT AND TRADEMARK OFFICE

CERTIFICATE OF CORRECTION

PATENT NO. : 6,026,534

DATED : February 22, 2000

INVENTOR(S) : Gonda et al.

It is certified that error appears in the above-indentified patent and that said Letters Patent is hereby corrected as shown below:

On the title page, in the Assignee area please change:

"Lever Brothers Company, New York, N.Y." to —Lever Brothers Company, Division of Conopco, Inc.—.

Signed and Sealed this

Fourteenth Day of November, 2000

*Attest:*

Q. TODD DICKINSON

*Attesting Officer*

*Director of Patents and Trademarks*